United States Patent [19]

Hanyu et al.

[11] Patent Number: 4,907,517

[45] Date of Patent: Mar. 13, 1990

[54] SEWING MACHINE WITH A DEVICE FOR GUIDING AN UPPER THREAD

[75] Inventors: Susumu Hanyu; Mikio Koike, both of Tokyo, Japan

[73] Assignee: Janome Sewing Machine, Tokyo, Japan

[21] Appl. No.: 166,639

[22] Filed: Mar. 11, 1988

[30] Foreign Application Priority Data

Mar. 19, 1987 [JP] Japan ..... 62-62448

[51] Int. Cl.[4] ..... D05B 40/02

[52] U.S. Cl. ..... 112/302; 112/241; 112/254

[58] Field of Search ..... 112/302, 241, 247, 249, 112/254

[56] References Cited

U.S. PATENT DOCUMENTS 4,688,501 8/1987 Mikuni et al. ..... 112/241

FOREIGN PATENT DOCUMENTS 251633 1/1988 European Pat. Off. ..... 112/241

1255691 11/1986 Japan ..... 112/241

*Primary Examiner*—5

*Assistant Examiner*—Andrew M. Falik

*Attorney, Agent, or Firm*—Michael J. Striker

[57] ABSTRACT

A thread guiding device in a sewing machine comprising a guide path for guiding an upper thread from a thread source to a needle and defined by a first thread guide, a pair of discs for releasably holding an upper thread, and a second thread guide formed by a spring hook of a thread tension spring member and an end portion of a take-up lever, the first and second thread guide and the thread tension spring member lying in a common plane to define a straight-line guide path.

17 Claims, 13 Drawing Sheets

SEWING MACHINE WITH A DEVICE FOR GUIDING AN UPPER THREAD

BACKGROUND OF THE INVENTION

The present invention relates to a sewing machine and, more particularly, relates to a device for guiding an upper thread.

In a thread guide path from a thread source to a needle eye of a lock stitching sewing machine, there are arranged a thread tension adjuster, a thread catching spring, a thread take-up lever and a plurality of thread guides. When a new upper thread is set or the upper thread is changed, these members must guide the upper thread. The thread guiding operation is not easy, particularly for beginners. If the upper thread is not properly guided, there exists a possibility that desired stitches are not formed.

SUMMARY OF THE INVENTION

It is an object of the invention to provide a device for enabling a machine operator to easily guide the upper thread.

According to the invention, a first thread guide, a thread tension adjuster, a spring thread tension means, a thread take-up lever, and a needle having a needle eye may be so arranged in a common plane as to define a straight-line thread guide path. Therefore, a beginner easily understands the upper thread guiding operation and can easily perform it.

DETAILED DESCRIPTION OF THE PREFERRED EMBODIMENT

Figure 1:
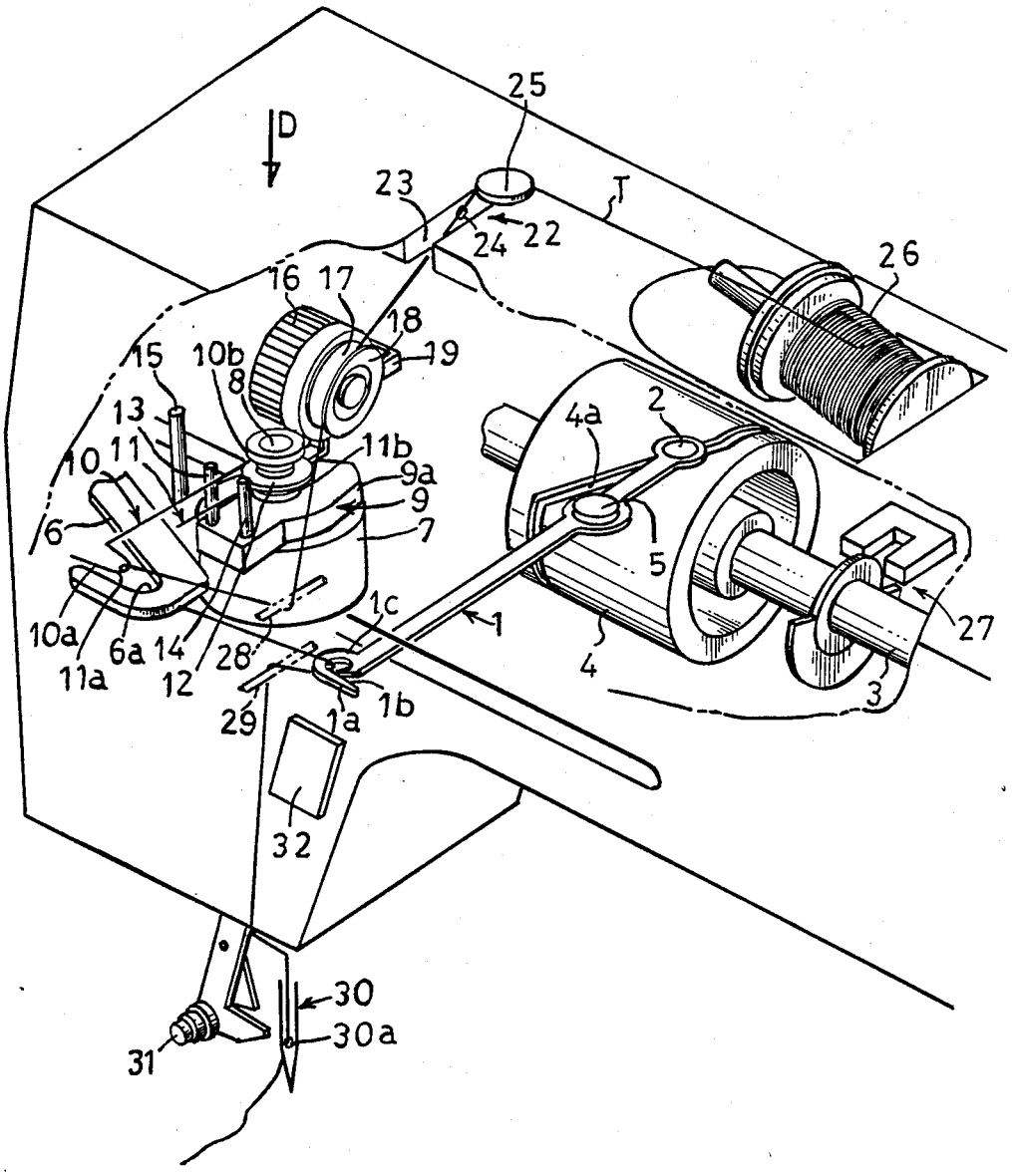
FIG. 1 is a perspective view of essential portions of a device for guiding the upper thread in a sewing machine.

As shown in FIG. 1, a thread take-up lever 1 has a lever hook 1*a* at its one end, formed with a thread hole

1*c* having an opening 1*b* so as to hold an upper thread T. A pin 2 disposed at the other end of the take-up lever 1, is held in engagement with a cam groove 4*a* of a cam drum 4 which is secured to an upper drive shaft 3 of the sewing machine. The take-up lever 1 is pivotally supported at its center part by a shaft 5 secured to a machine frame for lateral pivotal movement about the shaft 5 in a predetermined range defined by a left extreme point A and a right extreme point B as indicated in FIG. 2.

A base hook 6 is disposed adjacent to the left extreme point A of the reciprocation range of the lever hook 1*a* of the thread take-up lever 1. The hook 6 is formed with an opening 6*a* opposite to the opening 1*b* of the thread take-up lever 1. A motor 7 is fixed to the machine frame, a bed 9 is secured to an output shaft 8 of the motor 7, and a cam portion 9*a* is formed at the outer circumference of the bed 9.

Figure 2:
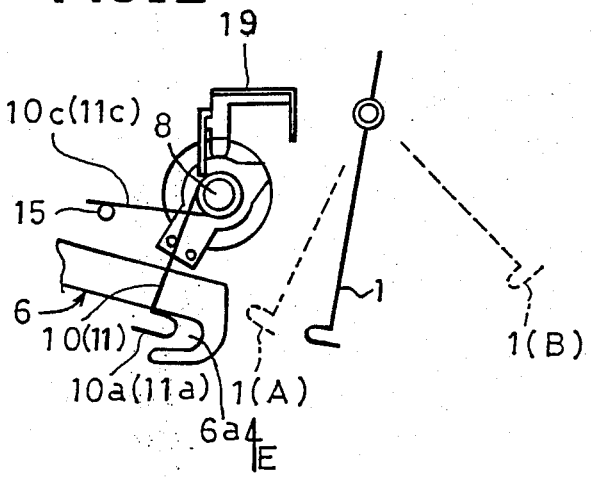
FIG. 2 is a plan view showing the essential portions seen along an arrow D in FIG. 1.

A pair of thread tension spring members 10 and 11 are so constructed that, as seen in FIG. 2, respective spring hook ends 10*a* and 11*a* having openings which are located within the opening 6*a* of the base hook 6 in the vertical plane thereof, and that, as shown in FIG. 1, the respective coiled portions 10*b* and 11*b* are snugly fitted on the output shaft 8 of the motor 7 with a ring 12 arranged therebetween. A pair of pins 13 and 14 are planted on the bed 9 as shown in FIG. 1, to act as stoppers during operation and non-operation of the thread tension spring members 10 and 11. A pin 15 secured to the machine frame serves as a stop for both other ends 10*c* and 11*c* of the respective thread tension spring members 10 and 11.

An upper thread tension adjuster 16 exerts an adjustable tension by means of a pair of discs 17 and 18, on the upper thread T which is clamped thereby.

Figure 4:
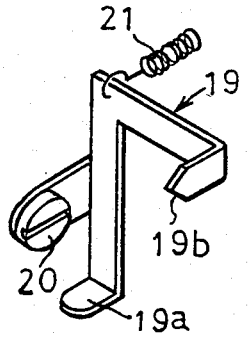
FIG. 4 is a perspective view of the essential portions of a thread tension adjuster releasing means.
Figure 3:
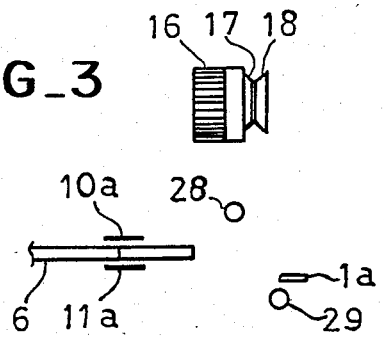
FIG. 3 is a front elevational view showing the essential portions seen along an arrow E in FIG. 2.

As shown in FIG. 4, a lever 19 is attached to the machine frame by a stepped screw 20. This lever is urged clockwise by a spring 21, so that a pawl 19*a* at one end thereof is pressed against the cam portion 9*a* of the bed 9 and that a pawl 19*b* at the other end thereof is located adjacent to the interspace of the discs 17 and 18.

As shown in FIG. 1, an upper thread detection unit 22 senses presence or absence of the upper thread T by means of a photosensor 24 which is located on a side surface of a thread guide recess 23. Numeral 25 designates a thread guide, to which the upper thread T drawn out of a thread source 26 is first guided.

A position detection device 27 detects an angular position of the upper drive shaft 3 to determine the left and right extreme positions A and B of the thread take-up lever 1.

Numerals 28 and 29 designate thread guide members, numeral 30 is a needle having a needle eye 30*a*, numeral 31 is a thread passing instrument, and numeral 32 is a set button.

The operation of the device will be described with reference to the respective figures, especially a flow chart shown in FIG. 13.

Figure 13:
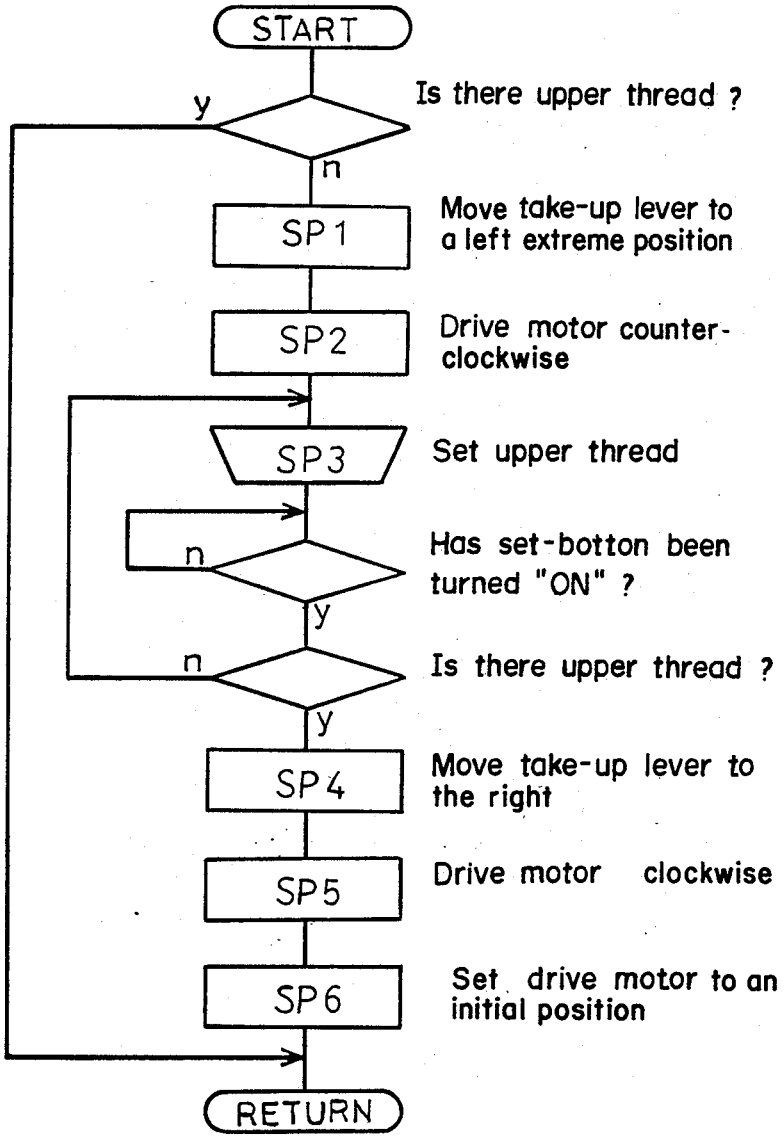
FIG. 13 is a flow chart showing the steps of program for the upper thread guide path setting operation.

When a power source is operational and the set button 32 is actuated, a program shown in the flow chart of FIG. 13 is started under control of a microcomputer.

The sensor 22 is energized to detect if the upper thread T is present in the thread guide recess 23. In the presence of the upper thread, the program ends. In the absence of the upper thread, the control flow shifts to steps SP1 and SP2.

SP1

Figure 5:
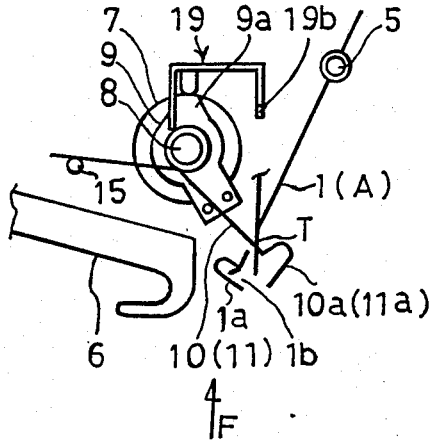
FIG. 5 is a plan view showing some members of the guiding device according to the invention in a position in which they form an additional thread guide.

The take-up lever 1 is moved to the left extreme point A as shown in FIG. 5. In this position of the lever 1 the needle eye 30*a* of the needle 30 is located above the upper surface of a needle plate.

SP2

Figure 6:
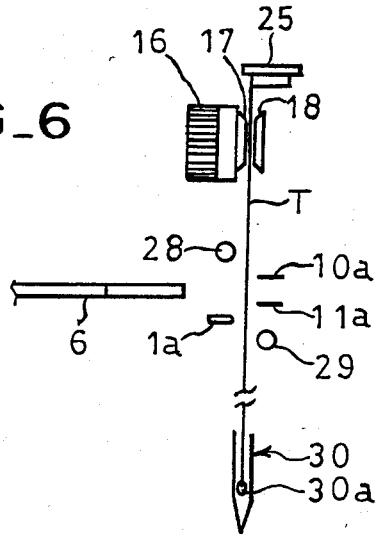
FIG. 6 is a front elevational view showing the essential members of the guiding device as seen along an arrow F in FIG. 5 defining a straight-line thread guide path.
Figure 8:
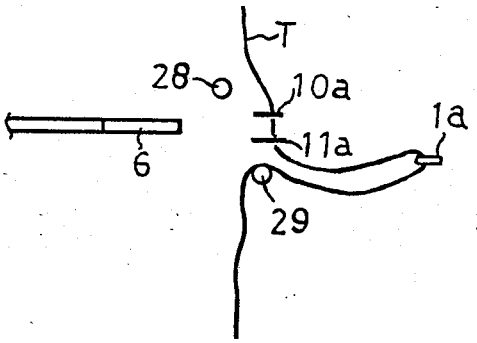
FIG. 8 is a view showing the essential portions seen along an arrow G in FIG. 7.

The output shaft 8 of the motor 7 is rotated counterclockwise from the state of FIG. 1, and simultaneously the bed 9 is turned in the same direction. The pin 13 therefore moves the spring hook ends 10*a*, 11*a* toward the lever hook end 1*a* from the state of FIG. 1 until the thread tension spring members 10, 11 cross the thread take-up lever 1 as shown in FIG. 5 wherein the spring hook ends 10*a*, 11*a* and the lever hook end 1*a* cooperate to provide an additional thread guide as shown. At the same time, the lever 19 is turned counterclockwise in FIG. 4 about the stepped screw 20 by the cam portion 9*a* of the bed 9, so that the pawl 19*b* moves into space between the pair of discs 17 and 19 to move the discs in the directions away from each other. Under this condition, the thread guide 25 to which the upper thread is first guided from the thread source 26, the pair of discs 17, 18 of the thread adjuster 16, the additional thread guide provided by the spring hook ends 10*a*, 11*a*, and the lever hook end 1*a*, and the needle are arranged in alignment in a common plane to provide a straight line thread guide path as illustrated in FIG. 6.

SP3

Under the condition shown in FIG. 5, manual setting of the upper thread T at the next step SP3 is performed. More specifically the upper thread T is pulled out from the source 26 and is guided to the thread guide 25, and it is led to the needle eye 30*a*, whereupon the upper thread T is passed through the needle eye 30*a* by a thread passing instrument 31. As described before, the thread guide path from the thread guide 25 to the needle eye 30*a* via the thread adjusting discs 17, 18 and the additional thread guide provided by the spring hook ends 10*a*, 11*a* of the thread tension spring members 10, 11 and the lever hook end 1*a* of the thread take-up lever 1 is straight lined in a common plane. Therefore, when the upper thread T is led to the needle eye 30*a*, the thread can be readily set in the space between the discs 17, 18 and in the additional thread guide as mentioned above. Moreover, the thread is easily led into the thread guide recess 23.

When the set button 32 is subsequently depressed, the presence of the upper thread T is detected by the upper thread detection unit 22, and the control shifts to a step SP4.

SP4

Figure 7:
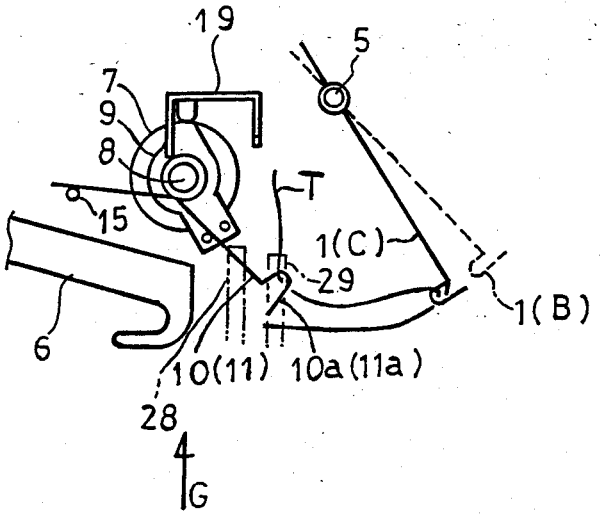
FIG. 7 is a plan view showing different operational positions of some members of the guiding device according to the invention.

The thread take-up lever 1 is moved to the right from the left extreme point A in FIG. 5 to the right extreme point B, and then is moved back to the left, and is stopped at a point C as shown in FIG. 7. Due to the movement of the thread take-up lever 1, the upper thread T is brought into engagement with the thread hole 1*c* of the thread take-up lever 1. Since the upper thread T is drawn out of the thread source 26 without tension acting thereon, it is in a loose state.

SP5

After the take-up lever 1 has been stopped at a position C as shown by a solid line in FIG. 7, the output shaft 8 of the motor 7 rotates the bed 9 clockwise until the spring hook ends 10*a*, 11*a* of the thread tension spring members 10, 11 go past the open end of the opening 6*a* of the base hook 6.

Figure 10:
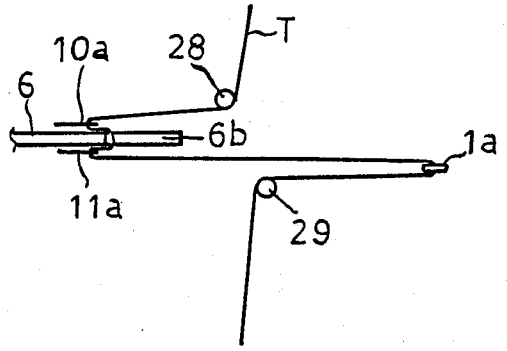
FIG. 10 is a view showing the essential portions seen along an arrow H in FIG. 9.
Figure 9:
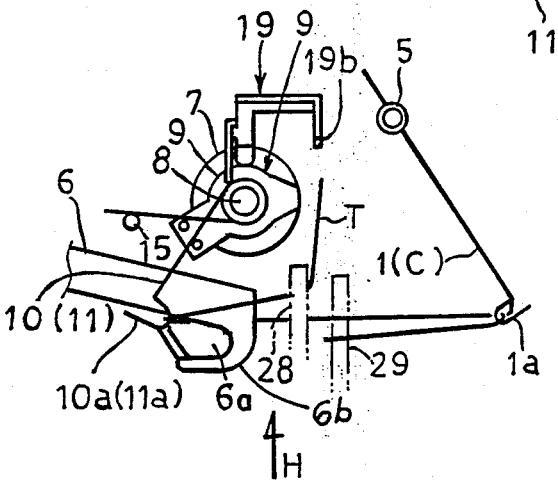
FIG. 9 is a plan view showing an operating process following the process in FIG. 7.

In the meantime, the lever 19 is turned clockwise from the position shown in FIG. 4, about the stepped screw 20 by the cam portion 9*a* of the bed 9, and the pawl 19*b* moves away from the interspace between the thread tension adjusting discs 17, 18, and the upper thread T is tensioned. Therefore, the part of the upper thread T between the thread tension adjuster 16 and the needle eye 30*a* is somewhat tightened, and a part of the upper thread T is moved, in contact with the outer circumferential surface 6*b* of the base hook 6 as shown in FIGS. 9 and 10, and the thread is inserted into the opening 6*a* of the base hook 6.

SP6

Figure 12:
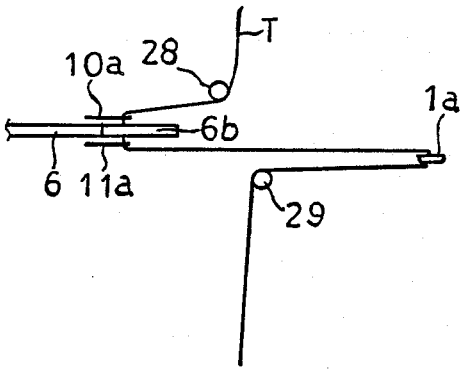
FIG. 12 is a view showing the essential portions seen along an arrow I in FIG. 11.
Figure 11:
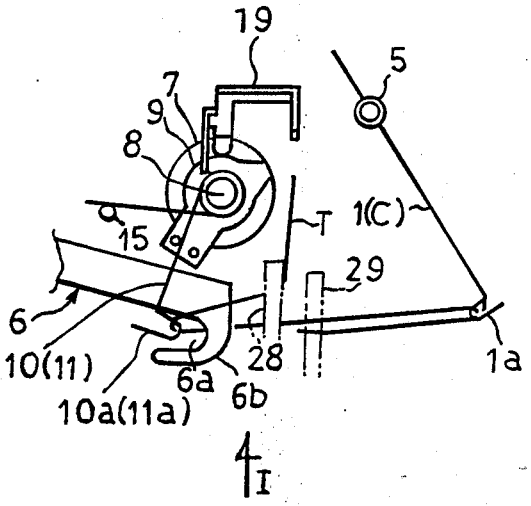
FIG. 11 is a plan view showing a state after the end of the upper thread setting operation.

After the output shaft 8 of the motor 7 has rotated the bed 9 until the thread T is located in the opening 6*a* of the base hook 6, the motor is reset counterclockwise until the spring hook ends 10*a*, 11*a* are positioned closer to the bottom of the opening 6*a* of the base hook 6 as illustrated in FIGS. 11 and 12. Thus the upper thread T engages the pin 28 between the thread tension adjuster 16 and the spring hook ends 10, 11*a*, and also engages the pin 29 between the lever hook end 1*a* and the needle, and a tension is applied to the thread T.

Thus, the thread setting operation of the sewing machine is completed and the sewing machine is ready for the subsequent stitching operation.

As it is understood from the above description, the thread setting operation is very easy. Beginners operating the sewing machine can not commit an error. Namely, the operator is only required to depress the set button after the power source is turned on and then to draw out the upper thread from the thread source guiding the thread around the first thread guide and guiding directly to the needle eye. The thread tension adjuster, the thread tension spring members and the thread take-up lever are arranged to receive the upper thread only if the thread end passed through the needle eye.

What is claimed is:

1. A device for guiding an upper thread through a guide path in a sewing machine from a thread source to a needle having a needle eye through which the upper thread extends, said device comprising:

a take-up lever including a thread holding end portion having an opening for receiving the upper thread, said take-up lever having a predetermined position in the guide path in which the upper thread passes through said opening;

first means for moving said take-up lever into and out of said predetermined position;

thread tension spring means having end portion means with opening means facing said opening in said thread holding end portion of said take-up lever; and second means for moving said thread tension spring means between a stitching position and a position in which said thread tension spring means and said take-up lever are substantially lined up in a common plane when said take-up lever is in said predetermined position thereof to facilitate the insertion of the upper thread.

2. A device as defined in claim 1 further comprising a thread hook having an opening opposite said opening of said take-up lever, said second moving means moving said thread tension spring means relative to said thread hook to displace a portion of the upper thread into said opening of said take-up lever.

3. A device as defined in claim 2 further comprising:
means for detecting presence of the upper thread in the guide path;
set means for manually designating setting of the upper thread; and
control means for actuating said first moving means to move said take-up lever into said predetermined position when said detecting means does not detect presence of the upper thread in the guide path, said control means in response to both said detecting means detecting presence of the upper thread in the path and actuation of said set means, actuating said first moving means to move said take-up lever out of said predetermined position and actuating said second moving means to move said thread tension spring means into the stitching position thereof.

4. A device as defined in claim 3, wherein said set means include a button depressible for resetting said thread tension spring means to the stitching position thereof.

5. A device as defined in claim 1, further comprising:
thread tension adjusting means for tensioning the upper thread in the guide path; and
means for releasing said thread tension adjusting means.

6. A device as defined in claim 1, further comprising means for detecting said take-up lever in said predetermined position.

7. A method of guiding an upper thread through a guide path in a sewing machine including a take-up lever and thread tension spring means, said method comprising the steps of:
guiding an upper thread from a thread source through the guide path to a needle eye and the needle eye;
moving the take-up lever into and out of a predetermined position in the guide path in which the upper thread passes through an opening in a thread holding end portion of the take-up lever;
moving the thread tension spring means between a stitching position and a position in which the thread tension spring means and the take-up lever are substantially lined up in a common plane when the take-up lever is in the predetermined position thereof, the thread tension spring means having thread holding portions arranged to oppose the thread holding end portion of the take-up lever.

8. A method as defined in claim 7, wherein the step of moving the thread tension spring means includes moving the thread tension spring means relative to a thread hook having an opening arranged opposite the opening of the thread holding end portion of the take-up lever to displace a portion of the upper thread into the opening of the take-up lever.

9. A method as defined in claim 8, further comprising the steps of:
detecting presence of the upper thread in the guide path;
moving of the take-up lever into the predetermined position thereof in response to absence of the upper thread in the path, and moving of the take-up lever out of the predetermined position and moving of the thread tension spring means into the stitching position thereof in response to detecting presence of the upper thread in the guide path.

10. A method as defined in claim 7, further comprising the steps of:
applying tension to the upper thread in the guide path; and
releasing the tension.

11. A method as defined in claim 7, further comprising the step of:
detecting the take-up lever reaching the predetermined position.

12. A sewing machine in which an upper thread is guided from a thread source to a needle having a needle eye, said sewing machine comprising:
thread tension adjusting means including a pair of discs for releasably holding the upper thread with an adjustable tension, said thread tension adjusting means being arranged between said thread source and said needle;
first guide means including a first thread guide arranged between said thread source and said thread tension adjusting means for guiding the upper thread from said thread source;
thread tension spring means including a spring member having a spring hook end with an opening therein, said spring member being arranged between said thread tension adjusting means and said needle and being laterally movable within a predetermined range in a horizontal plane;
a thread take-up lever having an end portion with an opening provided therein, and arranged between said thread tension adjusting means and said needle, said thread take-up lever being laterally movable in a predetermined range in a horizontal plane;
first means operatively connected to said thread take-up lever for moving the same;
second means operatively connected to said spring thread tension means for moving the same;
program operated control means for actuating said first and second moving means to move said spring thread tension means and said thread take-up lever to a position in which spring hook end and said end portion cooperate with each other to form a second thread guide;
said first thread guide, said pair of discs, said second thread guide, and said needle being arranged in alignment in a common plane to define a straight line thread guide path in the absence of the upper thread to facilitate the insertion of the upper thread.

13. A sewing machine as defined in claim 12, further comprising third thread guide means including a first pin arranged between said thread tension adjusting means and said needle; and fourth thread guide means including a second pin arranged between said first pin and said needle.

14. A sewing machine as defined in claim 12, further comprising a sensor located between said first guide means and said thread tension adjusting means for detecting presence of the upper thread therebetween, and an operating button for actuating said control means upon said sensor detecting absence of the upper thread between said first guide means and said thread tension adjusting means for moving said spring thread tension means and said take-up lever to the position in which said second thread guide is formed.

15. A sewing machine as defined in claim 12, further comprising releasing means operated in association with said first moving means to move said pair of discs of said thread tension adjusting means to a thread releasing condition to provide for insertion of the upper thread.

16. A sewing machine as defined in claim 15, wherein said releasing means comprises a cam rotatable in association with said second moving means, and a lever operable by said cam to move said pair of discs of said thread tension adjusting means in directions away from each other.

17. A sewing machine as defined in claim 12, wherein said second moving means comprises an electric motor, and said second actuator means comprising a cam rotatable in association with an upper drive shaft of the sewing machine.

* * * * *